US007207785B2

(12) United States Patent
Dalton et al.

(10) Patent No.: US 7,207,785 B2
(45) Date of Patent: Apr. 24, 2007

(54) VANE PUMP WEAR SENSOR FOR PREDICTED FAILURE MODE

(75) Inventors: William H. Dalton, Amston, CT (US); Kurt G. Grochowski, Wallingford, CT (US)

(73) Assignee: Goodrich Pump & Engine Control Systems, Inc., West Hartford, CT (US)

( * ) Notice: Subject to any disclaimer, the term of this patent is extended or adjusted under 35 U.S.C. 154(b) by 725 days.

(21) Appl. No.: 10/715,245

(22) Filed: Nov. 17, 2003

(65) Prior Publication Data

US 2004/0131477 A1 Jul. 8, 2004

Related U.S. Application Data

(63) Continuation-in-part of application No. 09/966,132, filed on Sep. 28, 2001, now Pat. No. 6,663,357, which is a continuation-in-part of application No. 09/741,524, filed on Dec. 20, 2000, now Pat. No. 6,375,435.

(60) Provisional application No. 60/236,293, filed on Sep. 28, 2000.

(51) Int. Cl.
*F04B 1/12* (2006.01)
*F04B 49/00* (2006.01)

(52) U.S. Cl. ..... 417/269; 417/284

(58) Field of Classification Search ..... 417/212, 417/279, 284, 220, 283, 289; 418/268, 30
See application file for complete search history.

(56) References Cited

U.S. PATENT DOCUMENTS 869,397 A * 10/1907 Tippett ..... 418/268
2,641,195 A 6/1953 Ferris
2,962,972 A 12/1960 Van Meter
3,401,641 A 9/1968 Adams et al.
3,598,510 A 8/1971 Aoki
3,711,227 A 1/1973 Schmitz
4,354,809 A 10/1982 Sundberg (Continued)

FOREIGN PATENT DOCUMENTS

BE 445 487 A 6/1942

(Continued)

OTHER PUBLICATIONS

U.S. Provisional Appl. No. 60/236,293.

(Continued)

*Primary Examiner*—Michael Koczo
*Assistant Examiner*—Jessica Frantz
(74) *Attorney, Agent, or Firm*—David J. Silvia; Edwards Angell Palmer & Dodge LLP

(57) ABSTRACT

A vane pump is disclosed for use with gas turbine engines that is adapted and configured to provide a failure mode similar to that of a traditional gear pump. The vane pump includes a pump housing, a cam member, a cylindrical rotor member and a mechanism for communicating a high pressure fluid from the discharge arc region to the inlet arc region when the tip surface of each vane element has experienced a predetermined amounted of wear so as to prevent pump startup. The tip surface of each vane element wears as a result the sliding contact with the circumferential surface of the pumping cavity.

14 Claims, 5 Drawing Sheets

U.S. PATENT DOCUMENTS 4,505,653 A 3/1985 Roberts
4,507,068 A 3/1985 Hayase et al.
4,556,372 A 12/1985 Leroy et al.
4,616,984 A 10/1986 Inagaki et al.
5,064,362 A 11/1991 Hansen
5,490,770 A 2/1996 Oogushi
5,545,014 A 8/1996 Sundberg et al.
5,545,018 A 8/1996 Sundberg
5,716,201 A 2/1998 Peck et al.
5,733,109 A 3/1998 Sundberg
5,833,438 A 11/1998 Sundberg
6,015,278 A 1/2000 Key et al.
6,027,323 A 2/2000 Martensen et al.
6,155,797 A * 12/2000 Kazuyoshi ..... 417/220
2003/0012671 A1 1/2003 Henderson

FOREIGN PATENT DOCUMENTS

GB 2 315 815 A 2/1998

OTHER PUBLICATIONS

U.S. Appl. No. 19/741,524. International Search Report dated Apr. 2002.
International Search Report dated Apr. 19, 2002.

* cited by examiner

VANE PUMP WEAR SENSOR FOR PREDICTED FAILURE MODE

CROSS-REFERENCE TO RELATED APPLICATIONS

This application is a continuation-in-part of U.S. patent application Ser. No. 09/966,132, filed Sep. 28, 2001, now U.S. Pat. No. 6,663,357 which is a continuation-in-part of U.S. patent application Ser. No. 09/741,524, filed Dec. 20, 2000, now U.S. Pat. No. 6,375,435 B2, and claims priority to U.S. Provisional Patent Application No. 60/236,293, filed Sep. 28, 2000, each of these references are herein incorporated by reference in their entirety.

BACKGROUND OF THE INVENTION

1. Field of the Invention

The subject invention relates to fuel pumps for gas turbine engines, and more particularly, to vane pumps which are used in applications that require high operational reliability and a predicted failure mode.

2. Background of the Related Art

Vane pumps are being developed within the aerospace industry as an alternative to traditional gear pumps. An example of a variable displacement vane pump is disclosed in U.S. Pat. No. 5,545,014 to Sundberg et al., the disclosure of which is herein incorporated by reference in its entirety to the extent that it does not conflict with the present disclosure.

Vane pumps traditionally include, among other things, a housing, a cam member and a rotor supported within the housing by axially opposed journal bearings. The housing defines an interior chamber, a fluid inlet and a fluid outlet and the cam member and rotor are disposed within the interior chamber. The cam member has a central bore which defines the circumferential boundary of the internal pumping chamber. Mounted for rotational movement within the central bore of the cam member, is a rotor supported by axial opposed journal bearings. The rotor element has circumferentially spaced apart slots machined therein which support corresponding radially movable vane elements.

Variable displacement vane pumps differ from other vane pumps, such as fixed displacement vane pumps, in that the cam member pivots about a fulcrum aligned with the vertical centerline of the pump, thereby adjusting its position with respect to the rotor. This adjustment allows the relative volumes of the inlet and discharge buckets to be changed and thereby vary the displacement capacity of the pump.

In a single rotation, the vanes of the rotor element of the pump traverse at least four distinct arcuate regions which make up the 360 degree revolution. The first region is the inlet arc segment in which fluid is received into the pumping chamber and over this region the bucket volume increases. The second region is the discharge arc segment in which pressurized fluid is discharged from the pumping chamber and over this region the bucket volume decrease. Lastly, seal arc segments separate the inlet and discharge arc segments and represent the regions through which the bucket volume remains substantially constant.

In operation, fluid at a first pressure is fed into the pumping chamber through the housing inlet, and into the space defined between adjacent vane elements, known as the bucket. In positive displacement vane pumps, as the vane elements rotate within the pumping chamber from the inlet region to the outlet region, the configuration of the cam member causes the vanes to retract within the corresponding slots. This causes the volume defined by the bucket to decrease. Since the amount of fluid received into an inlet bucket is greater than that contained within the corresponding discharge bucket, a fluid volume equivalent in size to the volumetric difference is discharged or displaced through the outlet port at a pressure equal to the downstream pressure which must be overcome.

Typically, pumping pressures and velocities are so high within the pump housing that the use of heavy, high wear resistant materials for the cam member and the vane elements becomes necessary to handle the wear which is caused by these high levels of pressure and velocity.

Prior variable displacement vane pumps are illustrated in U.S. Pat. No. 5,545,014 to Sundberg et al. and U.S. Pat. No. 5,833,438 to Sundberg. U.S. Pat. No. 5,545,014 discloses a durable, single action, variable displacement vane pump capable of undervane pumping and a pressure balancing method. U.S. Pat. No. 5,833,438 to Sundberg teaches a variable displacement vane pump having a durable rotor member with journal ends at each side of a large diameter central vane section and a mechanism for confining the high pressure within the cam member and thereby preventing axial pressure leakage along the length of the rotor member. The disclosure contained within these patents is hereby incorporated by reference in their entirety to the extent it does not conflict with the present disclosure.

The advantages of variable displacement pumps over conventional pumps, namely gear pumps, is that they solve the problem where excess heat generation becomes a crucial impediment to pump performance. Also, a variable displacement vane pump can be used to eliminate certain fuel flow metering components by utilizing the pump as the metering device.

One of the disadvantages associated with vane pump technology is the failure mode. As a result, there is a reluctance to implement this technology in applications, such as high performance aircraft, that require high operational reliability and a predicted failure mode. With a conventional gear pump, the failure mechanism is well known. Typically as the pump degrades, the performance drops off far enough so that eventually one cannot start the engine, thus a safe failure occurs. With a vane pump, however, as the vanes wear away due to contact with the cam surface, the cantilevered load that the pressure puts on each vane can become so high that a catastrophic failure of a vane can occur during pump operation and effectively destroys the whole pumping system without warning. In applications such as helicopter fuel systems, this type of failure can cause damage to the control system and engine. In order to prevent such an occurrence, the vane pump must be inspected and maintained frequently.

In view of the foregoing, a need exists for an improved vane pump which resembles the failure mode of a gear pump by "tracking" wear of the vanes, and disabling the engine from starting after a certain level of wear is attained.

SUMMARY OF THE INVENTION

The subject application is directed to vane pumps for use with gas turbine engines which include a mechanism for altering the failure mode of the pump thereby preventing an operational failure. In a preferred embodiment, the vane pump includes a pump housing, a cam member, a rotor member and a mechanism for communicating a high pressure fluid from the discharge arc region to the inlet arc region so as to prevent pump start-up when a predetermined wear state has been reached.

The pump housing typically includes a cylindrical interior chamber which defines a central axis through which a vertical centerline and a horizontal centerline extend. The cam member is mounted for pivotable movement within the interior chamber of the pump housing about a fulcrum aligned with the vertical centerline of the interior chamber. The cam member has a bore extending therethrough which defines a circumferential surface of a pumping cavity. The pumping cavity includes a discharge arc region, an inlet arc region and seal arc regions separating the inlet arc region and the discharge arc region from one another.

The cylindrical rotor member is mounted for rotational movement within the bore of the cam member about the central axis of the interior chamber. The rotor member has a central body portion with first and second axially opposed end surfaces and a plurality of circumferentially spaced apart radially extending vane slots formed therein. Each vane slot supports a corresponding vane element mounted for radial movement therein. Each of the vane elements have a radially outer tip surface which is adapted for slideably engaging the circumferential surface of the pumping cavity and a radially inner undervane portion which is positioned within each vane slot.

The mechanism for communicating a high pressure fluid from the discharge arc region to the inlet arc region so as to prevent pump start-up activates when the tip surface of each vane element has worn a predetermined amounted with respect to the undervane portion of each vane element.

In a preferred embodiment, the mechanism for communicating a high pressure fluid from the discharge arc region to the inlet arc region when the tip surface of each vane element has worn a predetermined amount includes arcuate channels formed in the first end surface of the body portion of the rotor member. The arcuate channels each extend between each vane slot. It is envisioned that the arcuate channels are spaced from the central axis by a radial distance and the radial distance defines the predetermined amount of wear.

Preferably, the means for communicating a high pressure fluid from the discharge arc region to the inlet arc region when the tip surface of each vane element has worn a predetermined amount further includes arcuate channels formed in the second end surface of the body portion of the rotor member It is presently envisioned that the predetermined amount of wear is reached when the undervane portion of each vane element at a point in the pumping cavity is positioned radially outward of the arcuate channels formed in the body portion of the rotor. As a result of this relative positioning, fluid is allowed to communicate from the discharge arc region to the inlet arc region of the pumping cavity.

In an alternate embodiment, the first end surface of the body portion of the rotor member has a circumferential recess formed in a radially outer portion thereof. The recess or relief creates a leak path for communicating fluid from the discharge arc region to the inlet arc region when the cam member is in a start-up position and an undervane portion of a vane element is positioned radially outward of a radially inner edge of the recess when such vane is positioned in the seal arc region of the pumping cavity.

Preferably, a circumferential recess is formed in the second end surface of the body portion of the rotor member. Additionally, it is envisioned that the radially inner edge of the recess formed in the first and/or second end surface(s) of the rotor member is spaced from the central axis by a radial distance, the radial distance defining an amount of allowable vane tip surface wear which can occur before high pressure fluid can leak from the discharge arc region to the inlet arc region of the pumping cavity.

Preferably, the circumferential surface of the pump cavity includes a discharge arc segment of about 144 degrees, a first seal arc segment of about 36 degrees, an inlet arc segment of about 144 degrees and a second seal arc segment of about 36 degrees. Those skilled in the art would readily appreciate that the angular length of each region is dependant upon the number of vane elements associated with the rotor. The above described arc lengths are consistent with a ten-vane rotor, however, a rotor having nine vanes, for example could be used. In a nine-vane rotor, the discharge and inlet arc segments would have an angular length of about 140 degrees and the seal arc segment would be about 40 degrees.

It is further envisioned that first and second axially spaced apart end plates are disposed within the interior chamber of the pump housing. Each end plate has a first surface which is adjacent to the rotor member and forms an axial end portion of the pumping cavity. Each end plate is spaced from the rotor member so as to allow frictionless rotation of the rotor member within the pumping cavity. Alternatively, the end plates could be in sliding contact with the rotor member. Preferably the end plates include a mechanism associated with the first surface of each end plate for communicating fluid from the discharge arc segment of the pumping cavity to the undervane portion of each vane element when each vane element passes through the discharge and seal arc segments. Additionally, the first surface of each end plate includes a mechanism for communicating fluid from the inlet arc region of the pumping cavity to the undervane portion of each vane element when each vane element passes through the inlet arc segment as the rotor member rotates about the central axis.

It is presently envisioned that the rotor member further includes a plurality of substantially axial fluid passages formed in the central body portion of the rotor. Each passage is positioned between the plurality of circumferentially spaced apart radial vane slots and provides a path through the rotor body portion for fluid to communicate axially from the pumping cavity to the first and second end plate.

Those skilled in the art will readily appreciate that the inventive aspects of this disclosure can be applied to any type of vane pump, such as fixed or variable displacement vane pumps.

BRIEF DESCRIPTION OF THE DRAWINGS

So that those having ordinary skill in the art to which the present application appertains will more readily understand how to make and use the same, reference may be had to the drawings wherein.

These and other features of the vane pump of the present application will become more readily apparent to those having ordinary skill in the art form the following detailed description of the preferred embodiments.

DETAILED DESCRIPTION OF PREFERRED EMBODIMENTS

Figure 1:
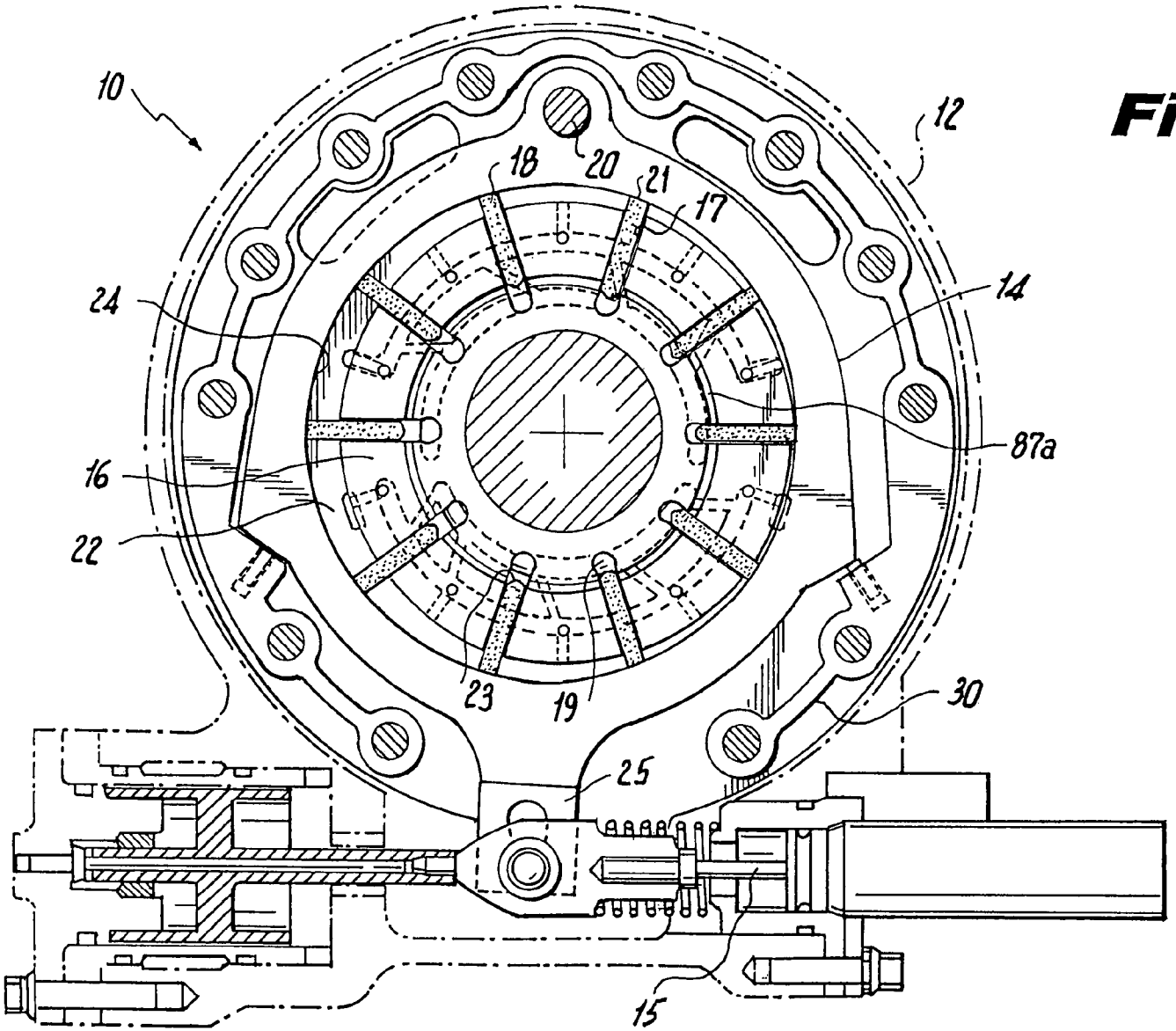
FIG. 1 is a cross-sectional view of a variable displacement vane pump constructed in accordance with a preferred embodiment of the present application which includes a pump housing, a pivotal cam member, and a rotor member with associated vane elements.

Referring now to the drawings wherein like reference numerals identify similar structural aspects of the subject invention, there is illustrated in FIG. 1 a variable displacement vane pump constructed in accordance with a preferred embodiment of the subject application and designated generally by reference numeral 10. Vane pump 10 includes a pump housing 12 defining an interior chamber which supports a cam member 14 and a rotor member 16. Rotor member 16 includes a plurality of radially extending slots 17. Each slot is configured to support a corresponding vane element 18. Cam member 14 is mounted for pivotal movement within pump housing 12 about a pivot pin 20 that defines a fulcrum, so as to vary the displacement of vane pump 10. Cam member 14 includes a one-piece body that defines a bore 22 forming a cam chamber. The circular bore 22 defines a smooth continuous circumferential surface 24 of the pumping cavity, making continuous contact with the outer tip surfaces 21 of each vane element 18. A lever 25 extends from the body of cam member 14 and is pivotably connected to actuation piston assembly 15, for varying the position of the cam member 14 relative to the rotor member 16.

As illustrated in FIG. 1, each vane element 18 fits snugly within a corresponding slot 17 and functions like a piston as it is depressed radially inwardly during movement of the rotor member 16 through the high pressure discharge arc region 62 (FIG. 3) of the pumping chamber. Each slot 17 has a radially inner undervane cavity 19 defining an area that is open to low inlet pressure when the vane element 18 is in the inlet arc region 60 (FIG. 3) of the pumping chamber, and to high discharge pressure when the vane element 18 is in the discharge arc region 62 of the pumping chamber and the seal arc regions 64*a* and 64*b* (FIG. 3) of the pumping chamber. The manner in which pressurized fluid is communicated to the undervane cavity will be described in more detail herein below with respect to FIG. 3.

Figure 2:
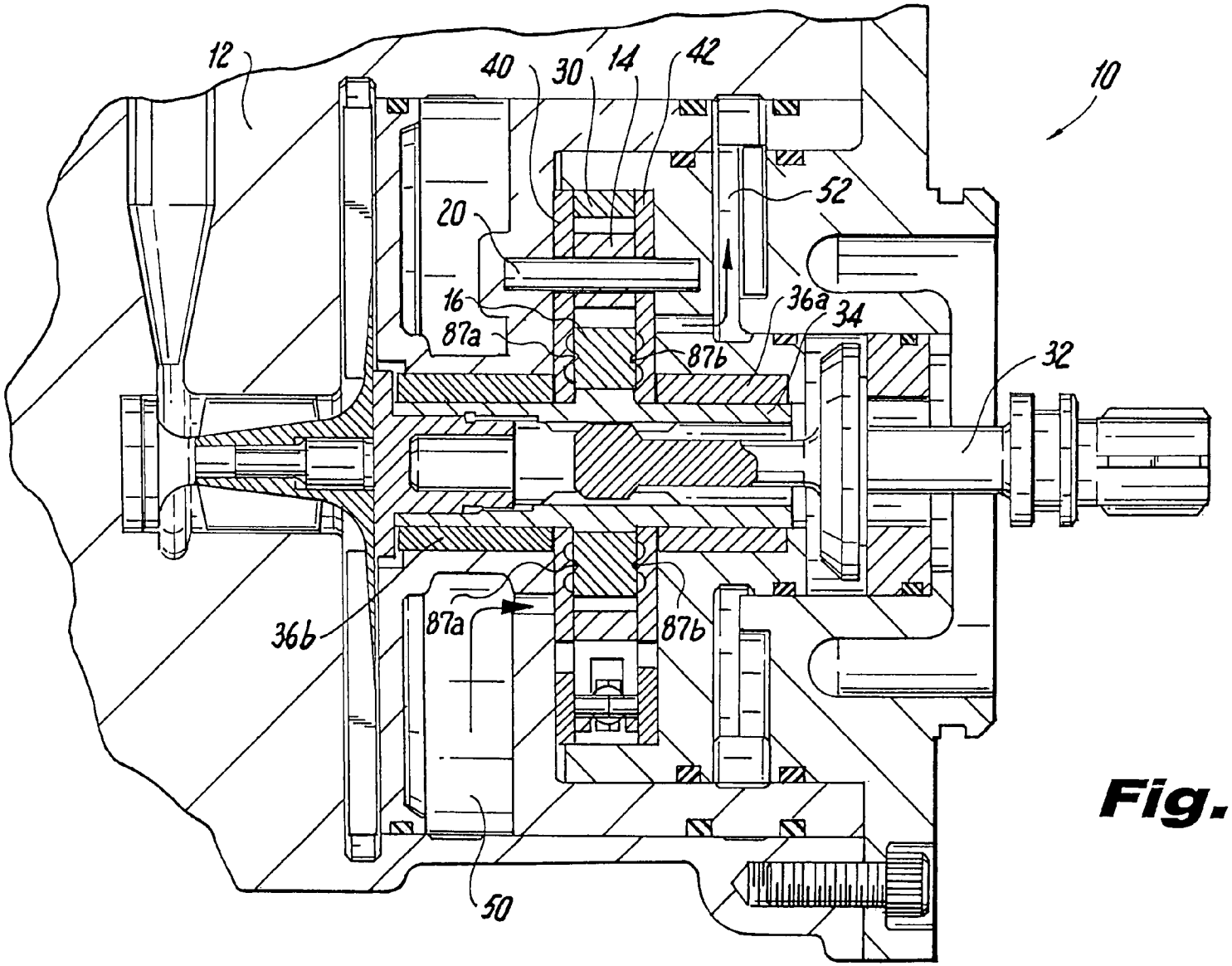
FIG. 2 is a side elevational view in cross-section of the vane pump of FIG. 1 illustrating the manner in which fluid is received into and discharged from the pumping chamber.

Referring to FIG. 2, vane pump 10 further includes an inlet region 50 for admitting low pressure fluid into the pumping chamber and a discharge region 52 for discharging high pressure fluid from the pumping chamber. A main drive shaft 32 extends through the interior chamber of pump housing 12 along the longitudinal axis thereof for driving a central shaft member 34. Shaft member 34 is supported for rotation by opposed journal bearings 36*a* and 36*b*, and is keyed to rotor member 16 for imparting rotational motion thereto.

Opposed sideplates 40 and 42, which are disposed within the interior chamber, form a sealed cavity between cam member 14 and rotor member 16, and provide inlet and discharge ports for the cavity. Axial spacer 30 is supported within the housing 12, between sideplates 40 and 42, and has a thickness that is slightly greater than the thickness of cam member 14. This allows the sideplates 40 and 42 to be tightly clamped against the spacer 30 by a plurality of threaded fasteners (not shown) while allowing small gaps to remain between the cam member 14 and the sideplates to reduce or eliminate friction therebetween.

Figure 3:
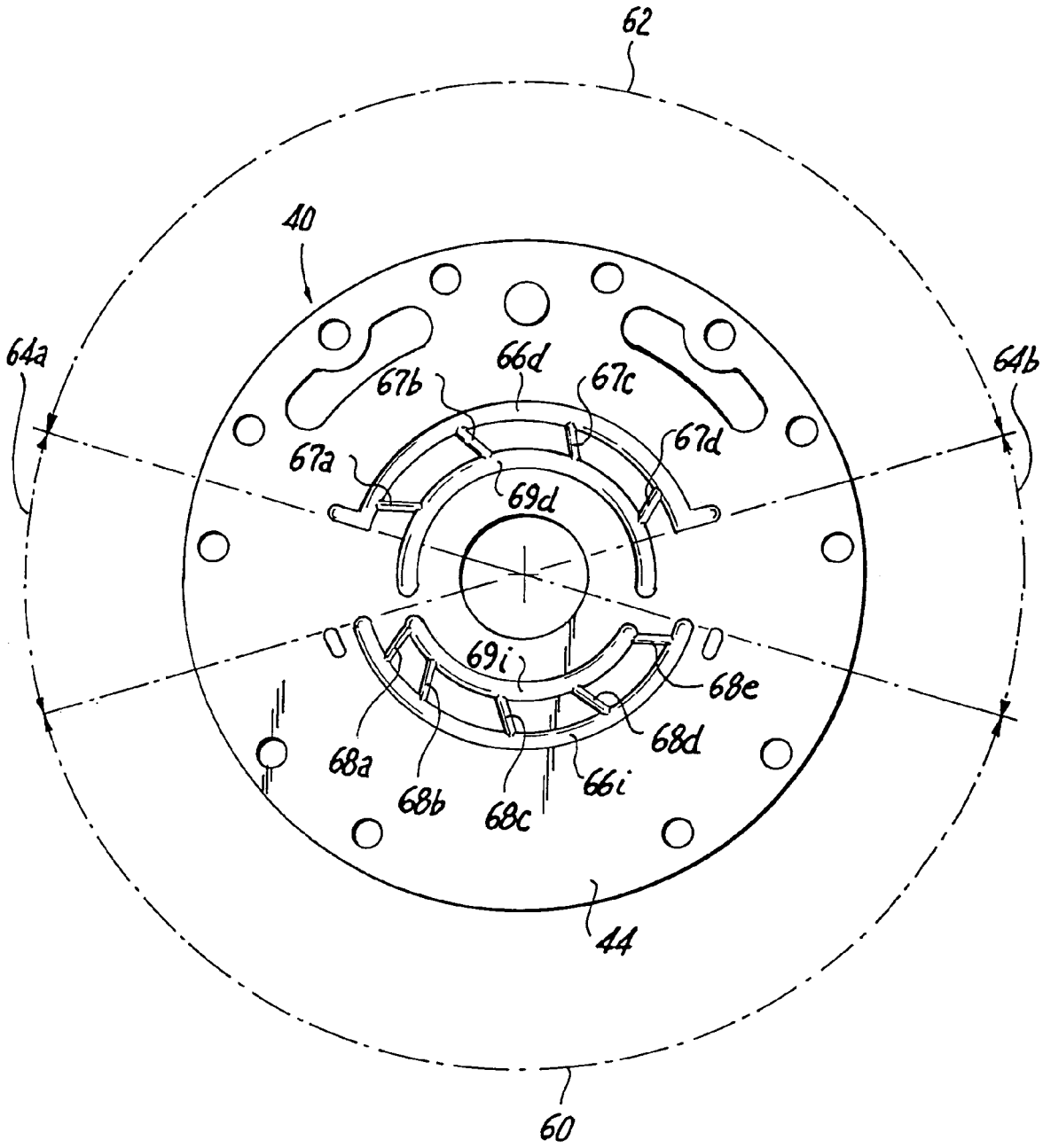
FIG. 3 is a side elavational view of the face of the end plate of the pump of FIG. 1 illustrating a series of channels and recesses formed therein.

Referring now to FIG. 3, surface 44 of side plate 40 is disposed adjacent rotor member 16. The 360 degree pumping chamber includes an inlet arc region 60, a discharge arc region 62 and sealing arc regions 64*a* and 64*b* positioned between the inlet and discharge arc regions 60 and 62. The inlet arc region 60 represents the portion of the pumping chamber in which the volume contained between adjacent vane elements (i.e., within the buckets) increases and low pressure fluid is received into the pumping chamber. The discharge arc region 62 is the portion of the pumping chamber in which the volume contained between adjacent vane elements decreases. In the seal arc regions 64*a* and 64*b*, the volume remains substantially constant.

When the rotor 16 rotates within the pumping chamber, the centrifugal force created thereby imparts a radially outward force on each vane elements 18. In addition, the pressurized fluid contained within adjacent buckets imparts a radially inward force on each adjacent vane element 18. Often, the opposed forces which are applied to each vane element 18 are not balanced. As a result, the vane tip 21 of each vane 18 is either subjected to excessive wear due to a net radially outward force or fluid leaks from within the bucket due to a net radially inward force. This reduces pumping efficiency. An ideal pump operating condition occurs when the pressure applied to the vane elements is balanced and the vane elements "float" within the slots defined in the rotor. This condition results in minimum wear to the vane tips and minimizes the pressure losses caused by the lack of contact between the vane tips and the cam member.

Pump 10 is adapted and configured to correct the unbalanced vane condition by applying pressure to the undervane portion 23 of each vane element 18. More specifically, low pressure from within each bucket traversing the inlet region 60 is supplied to the undervane portion 23 of vane elements 18 within the inlet arc region 60. Similarly, the undervane portion 23 of the vanes traversing the discharge arc region 62 and the seal arc regions 64*a* and 64*b* are supplied with high pressure from the buckets located in the discharge arc region 62. The pressure, in the form of pressurized fluid, is supplied from the inlet arc region 60 and discharge arc region 62 to the undervane portion 23 of each vane element 18 by way of flow ports machined in the rotor body portion and by providing end plates which have flow channels formed therein.

Figure 4:
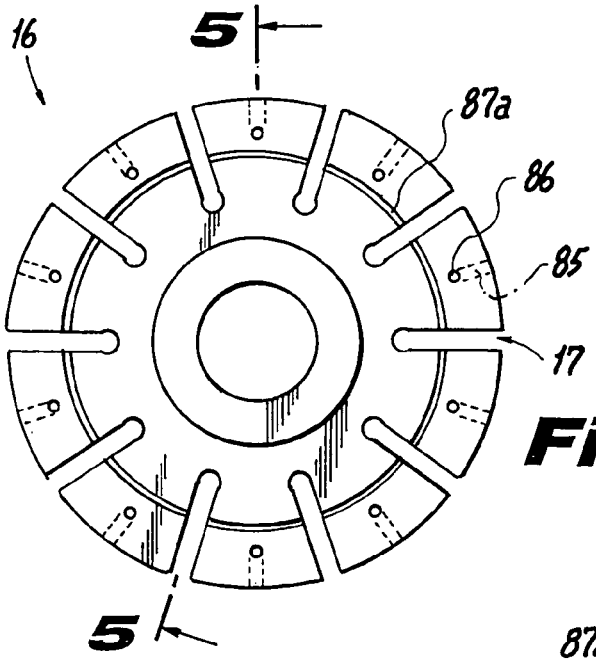
FIG. 4 is a cross-sectional view of the rotor of FIG. 2, the rotor having arcuate recesses or channels cut in each end of the body portion between adjacent vane slots.
Figure 5:
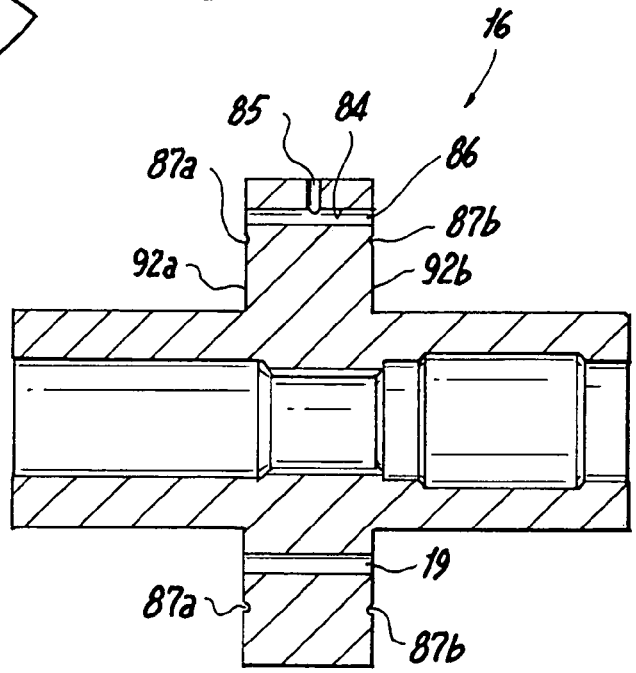
FIG. 5 is a side elevational view taken in cross-section of the rotor member of the vane pump of FIG. 1 illustrating arcuate channels formed in an end of the rotor for allowing high pressure fuel to communicate with the low pressure side of the sealing arc when a pre-established vane wear state has been reached.

Referring to FIGS. 4 and 5, the body portion 19 of rotor 16 includes a plurality of flow ports 84 formed therein. Each flow port 84 is positioned between the plurality of circumferentially spaced apart radial vane slots 17 and provides a path for fluid to flow from the pumping cavity to channels 66*i* and 66*d* (see FIG. 3) formed in end plate 40, or in both end plate 40 and 42. Each flow port 84 is substantially T-shaped and includes a radial conduit 85 and an axial conduit 86.

This feature is advantageous because fluid must travel radially inward from the bucket into each flow port 84, against the centrifugal force created by the rotation, so that the fluid is effectively filtered prior to entering each flow port 84. Moreover, particulate contained within the fluid in the pumping chamber is forced radially outward by the centrifugal motion, leaving particulate free fluid on the radially inner portion of the bucket.

Referring now to FIG. 3, arcuate outer channels 66*i* and 66*d* are formed in face 44 of endplate 40 and are in fluid communication with the inlet and discharge arc regions, 60 and 62, respectively by way of flow ports 84 of rotor member 16. Low pressure fluid from the inlet arc region 60 is received into arcuate outer channel 66*i* and then flows radially inward through passages 68*a–e* to arcuate inner channel 69*i*. The passages 68*a–e* and the inner channel 69*i* are also formed in face 44 of side plate 40. Inner channel 69*i* communicates with the undervane portion of each vane element 18 positioned within the inlet arc region 60.

In a similar manner, on the discharge side of the pumping chamber, high pressure fluid from within the discharge arc region 62 is received by arcuate outer channel 66*d*. The fluid then flows radially inward through passages 67*a–d* to arcuate inner channel 69*d*. As before, the passages 67*a–d* and the inner channel 69*d* are each machined into face 44 of side plate 40. Arcuate inner channel 69*d* communicates with the undervane portion of each vane element 18 positioned within the discharge arc region 62 and the sealing arc regions 64*a* and 64*b*. One skilled in the art would readily appreciate that the quantity of channels and passages can be varied depending on the configuration of the pump and the associated operating pressures.

The communication of pressurized fluid through the above described series of ports and channels to the undervane portion of each vane element functions to balance the forces imparted on the vanes or at least to ensure that a net force directed radially outward is applied thereto. Other techniques for balancing the forces imparted on the vanes can be used without departing from the inventive aspects of this disclosure. For example, the technique disclosed in U.S. Pat. No. 6,634,865 to Dalton can be used in place of the above-described method. The '865 patent illustrates a method wherein high pressure fluid from the buckets within the discharge arc region is supplied to the undervane portion of each vane in the discharge arc region. Similarly, low pressure fluid from the buckets within the inlet arc region is supplied to the undervane portion of each vane in the inlet arc region. However, in contrast to the above-described technique, a mixture of high and low pressure fluid from both the discharge and inlet arc regions is supplied to the undervane portion of each vane element positioned in the seal arc region of the vane pump disclosed in the '865 patent.

As mentioned above, one of the disadvantages associated with vane pump technology is the failure mode. Unlike conventional gear pumps, which will not start up when the pumping elements have experienced a pre-determined amount of wear, traditional vane pumps fail without warning and often catastrophically during pump operation.

Fuel pump 10 is adapted and configured to change the failure mode normally associated with vane pump technology to one which is substantially similar to that of gear pumps. As illustrated in FIGS. 3 and 4, a series of leak paths 87*a* and 87*b* are formed in ends 92*a* and 92*b* of body portion 19 of rotor member 16. These leak paths 92*a* and 92*b* allow high pressure fluid which is contained within arcuate outer channel 66*d*, arcuate inner channel 69*d* and passages 67*a–d* to flow into the low pressure inlet arc region 60 when the vane elements 18 have worn such that the undervane portion 23 is positioned radially outward of leak paths 87*a* and 87*b*.

More specifically, in a variable displacement vane pump, maximum vane protrusion from within the corresponding slot occurs when cam member 14 is disposed in the position corresponding to pump start-up, as illustrated in FIG. 1. As depicted, in the pump start-up position, the vane elements 18 located in sealing arc region 64*a* are subjected to the maximum protrusion from within the vane slots 17. When vane pump 10 is new and not worn, the undervane portion 23 of each vane element 18 prevents fluid from flowing into leak paths 87*a* and 87*b*. However, as the vane tips 21 wear due to their contact with the circumferential surface 24 of the pumping cavity, the radial position of the undervane portion 23 of each vane element 18 with respect to leak paths 87*a* and 87*b* is altered. Eventually, the vane elements 18 wear to the extent that the undervane portion 23 is positioned radially outward of the leak paths 87*a* and 87*b*, and can no longer prevent fuel from leak paths 87*a* and 87*b*. Consequently, the leak paths 87*a* and 87*b* formed in rotor 16 begin to slowly communicate high pressure fuel to the low pressure inlet side of the sealing arc 64*a*.

Figure 6:
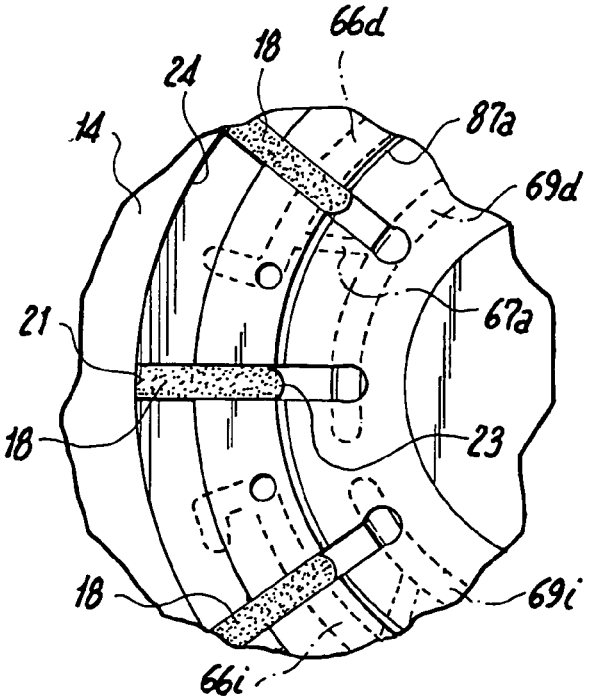
FIG. 6 is an enlarged localized cross-sectional view of a variable displacement vane pump in the worn state wherein fuel communicates from the high pressure side of the pumping chamber to the low pressure side of the sealing arc.

Referring now to FIG. 6, vane elements 18 of vane pump 10 are shown in a worn condition. As the vane elements 18 wear, it is through the channels or recesses formed in the end plates, that the high pressure communicates to the low pressure side of the pump. As wear continues further, this communication becomes more pronounced and substantial. Eventually, a certain level of leakage through this path is achieved such that the ability of the pump to provide sufficient flow to start the engine becomes diminished and start-up cannot occur. Thus, it will be necessary to remove the pump for overhaul prior to attaining a point where failure due to an overloaded vane is imminent and a major failure can be avoided.

The failure mode only affects the engine's ability to start. Higher leakage during operation is not critical to the survival of a mission and therefore there is no danger that the additional leakage will interfere with engine operation. This operational scenario is identical to that of a gear pump.

The radial position of the leak paths 87*a* and 87*b* are established based on the configuration and size of the pumping components and the material properties of the vane elements. The leak path location is selected so that the above-described failure mode is ensured and catastrophic operational failures are avoided.

Figure 7:
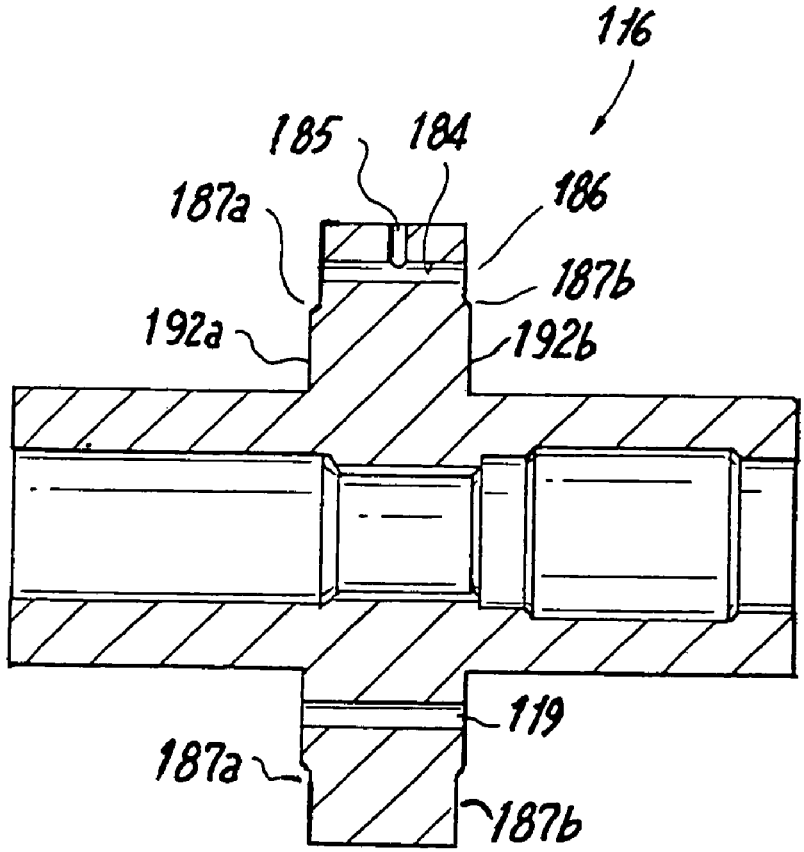
FIG. 7 is a side elevational view taken in cross-section of an alternative embodiment of the rotor member illustrating a circumferential recess or relief formed in the radially outer portion of both opposing ends of the rotor for allowing high pressure fuel to communicate with the low pressure side of the sealing arc when a pre-established vane wear state has been reached.

Referring now to FIG. 7, there is illustrated an alternative rotor for use in vane pump 10, which is designated bys reference numeral 116. Similar to rotor 16, rotor 116 is positioned within the interior chamber defined within pump housing 12 (FIG. 1) of vane pump 10 and includes a plurality of radially extending slots (not shown). Each slot is configured to support a corresponding vane element.

Like rotor 16, rotor 116 has a body portion 119 that includes a plurality of flow ports 184 formed therein. Each flow port 184 is positioned between the plurality of circumferentially spaced apart radial vane slots and provides a path for fluid to flow from the pumping cavity to channels 66*i* and 66*d* (see FIG. 3) formed in end plate 40, or in both end plates 40 and 42. Each flow port 184 is substantially T-shaped and includes radial and axial conduits, 185 and 186, respectively.

Rotor 116 is also adapted and configured to change the failure mode of vane pump 10 from the catastrophic mode normally associated with vane pump technology to one which is substantially similar to that of gear pumps. As described above with respect to prior embodiments, the failure mode in vane pump 10 is changed to one that resembles gear pumps by including a mechanism for communicating high pressure fluid from the discharge arc region to the inlet arc region, so as to prevent pump start-up when the tip surface of the vane elements have worn a predetermined amount with respect to the undervane portion of each element.

As previously discussed with respect to FIGS. 4–6, rotor 16 has a series of arcuate channels cut in the rotor ends 92*a* and 92*b* so as to form leak paths 87*a* and 87*b*. These leak paths 87*a* and 87*b* allow high pressure fluid which is contained within arcuate outer channel 66*d*, arcuate inner channel 69*d* and passages 67*a*–*d* to flow into the low pressure inlet arc region 60 when the vane elements 18 have worn such that the undervane portion 23 is positioned radially outward of leak paths 87*a* and 87*b*.

As shown in FIG. 7, rotor 116 has a pair of leak paths 187*a* and 187*b* formed in rotor ends 192*a* and 192*b*, respectively. These leak paths 187*a* and 187*b* function in a substantially similar manner as leak paths 87*a* and 87*b*. However, unlike rotor 16, the leak paths 187*a* and 187*b* of rotor 116 are formed by machining or otherwise forming a circumferential recess or relief in the radial outer portion of rotor ends 192*a* and 192*b*.

As before, when vane pump 10 is new and not worn, the undervane portion of each vane element 18 prevents fluid from flowing into leak paths 187*a* and 187*b*. However, as the vane tips wear due to their contact with the circumferential surface 24 of the pumping cavity, the radial position of the undervane portion of each vane element with respect to leak paths 187*a* and 187*b* is altered. Eventually, the vane elements wear to the extent that the undervane portion is positioned radially outward of the radially inner edge of leak paths 187*a* and 187*b*, and can no longer prevent fuel from entering leak paths 87*a* and 87*b*. Consequently, the leak paths 187*a* and 187*b* formed in rotor 116 begin to slowly communicate high pressure fuel to the low pressure inlet side of the sealing arc 64*a* (FIG. 3).

As wear continues further, this communication becomes more pronounced and substantial. Eventually, a certain level of leakage through this path is achieved such that the ability of the pump to provide sufficient flow to start the engine becomes diminished and start-up cannot occur. Thus, it will be necessary to remove the pump for overhaul prior to attaining a point where failure due to an overloaded vane is imminent and a major failure can be avoided.

Similarly to leak paths 87*a* and 87*b*, the radial position of the leak paths 187*a* and 187*b* are established based on the configuration and size of the pumping components and the material properties of the vane elements. The leak path location is selected so that the above-described failure mode is ensured and catastrophic operational failures are avoided.

The machining of leak paths 187*a* and 187*b* into rotor ends 192*a* and 192*b*, respectively, affords the added benefit of reducing the amount of pumping energy that is lost due to frictional losses. More specifically, during the operation of vane pump 10, sliding contact typically exists between the radially outer portion of the rotor ends and the end plates. This contact is caused by a slight titling of the axis for the rotor due to the radial clearance that is provided between the axially opposed journal bearings 36*a* and 36*b* (FIG. 2) and the rotor 116. By machining a relief (or leak paths 187*a* and 187*b*) in the radially outer portion of rotor ends 192*a* and 192*b* this frictional contact is substantially eliminated and pumping efficiency is improved.

It is envisioned that the porting connections of the pump can be achieved through a variety of methods. Pump configurations can use various cuts in cams, sideplates and rotors to communicate different pressures for different reasons including, but not limited to, bearing lubrication, pressure balancing and the like. The preferred embodiment of the invention utilizes porting cuts in the rotor to provide for vane pump with a controlled failure mode and operational reliability similar to that of a gear pump.

While the invention has been described with respect to preferred embodiments, those skilled in the art will readily appreciate that various changes and/or modifications can be made to the invention without departing from the spirit or scope of the invention as defined by the appended claims.

What is claimed is:

1. A vane pump comprising:

a) a pump housing having an interior chamber that defines a central axis through which a vertical centerline and a horizontal centerline extend;

b) a cam member mounted within the interior chamber of the pump housing and having a bore extending axially therethrough and defining a circumferential surface of a pumping cavity, the pumping cavity including a discharge arc region, an inlet arc region and seal arc regions separating the inlet arc region and the discharge arc region from one another; and c) a substantially cylindrical rotor member mounted for rotational movement within the bore of the cam member about the central axis of the interior chamber, the rotor member having a central body portion with first and second axially opposed end surfaces and a plurality of circumferentially spaced apart radially extending vane slots formed therein, each vane slot supporting a corresponding vane element mounted for radial movement therein, each vane element having a radially outer tip surface adapted for slideably engaging the circumferential surface of the pumping cavity and a radially inner undervane portion within each vane slot, the first end surface of the body portion having a circumferential recess formed in a radially outer portion thereof so as to create a leak path for communicating fluid from the discharge arc region to the inlet arc region when the cam member is in a start-up position and an undervane portion of a vane element is positioned radially outward of a radially inner edge of the recess formed in the first end surface when such vane is positioned in the seal arc region of the pumping cavity.

2. A vane pump as recited in claim 1, wherein the pump cavity includes a discharge arc region of about 144 degrees, a first seal arc region of about 36 degrees, an inlet arc region of about 144 degrees and a second seal arc region of about 36 degrees.

3. A vane pump as recited in claim 1, further comprising first and second axially spaced apart end plates disposed within the interior chamber of the pump housing, each end plate having a first surface which is adjacent to the rotor member, each first surface forming an axial end portion of the pumping cavity.

4. A vane pump as recited in claim 3, further comprising means associated with the first surface of each end plate for communicating fluid from the discharge arc region of the pumping cavity to the undervane portion of each vane element when each vane element passes through the discharge and seal arc regions and for communicating fluid from the inlet arc region of the pumping cavity to the undervane portion of each vane element when each vane element passes through the inlet arc regions as the rotor member rotates about the central axis.

5. A vane pump as recited in claim 3, wherein the rotor member further comprises a plurality of substantially axial fluid passages formed in the central body portion of the rotor, each passage positioned between the plurality of circumferentially spaced apart radial vane slots and providing a path through the rotor body portion for fluid to communicate axially from the pumping cavity to the first and second end plate.

6. A vane pump as recited in claim 1, wherein the radially inner edge of the circumferential recess formed in the first end surface of the rotor member is spaced from the central axis by a radial distance, the radial distance defining an amount of allowable vane tip surface wear which can occur before high pressure fluid can leak from the discharge arc region to the inlet arc region of the pumping cavity.

7. A vane pump as recited in claim 1, wherein the second end surface of the body portion of the rotor member has a circumferential recess formed in a radially outer portion thereof so as to create a leak path for communicating fluid from the discharge arc region to the inlet arc region when the cam member is in a start-up position and an undervane portion of a vane element is positioned radially outward of a radially inner edge of the recess formed in the second end surface when such vane is positioned in the seal arc region of the pumping cavity.

8. A vane pump comprising:

a) a pump housing having a cylindrical interior chamber defining a central axis through which a vertical centerline and a horizontal centerline extend;

b) a cam member mounted within the interior chamber of the pump housing and having a bore extending therethrough and defining a circumferential surface of a pumping cavity, the pumping cavity including a discharge arc region, an inlet arc region and seal arc regions separating the inlet arc region and the discharge arc region from one another; and c) a rotor member mounted for rotational movement within the bore of the cam member about the central axis of the interior chamber, the rotor member having a central body portion which includes first and second axially opposed end surfaces and a plurality of circumferentially spaced apart radially extending vane slots formed therein, each vane slot supporting a corresponding vane element mounted for radial movement therein, each vane element having a radially outer tip surface adapted for slideably engaging the circumferential surface of the pumping cavity and a radially inner undervane portion within each vane slot, the first end surface of the body portion having a circumferential recess formed therein and extending between each vane slot, wherein the circumferential recess is adapted and configured to provide a path for high pressure fluid to leak from the discharge arc region to the inlet arc region of the pumping cavity when each vane tip surface has worn such that the undervane portion is positioned radially outward of a radially inner edge of the recess.

9. A vane pump as recited in claim 8, wherein the pump cavity includes a discharge arc region of about 144 degrees, a first seal arc region of about 36 degrees, an inlet arc region of about 144 degrees and a second seal arc region of about 36 degrees.

10. A vane pump as recited in claim 8, further comprising first and second axially spaced apart end plates disposed within the interior chamber of the pump housing, each end plate having a first surface which is adjacent to the rotor member, each first surface forming an axial end portion of the pumping cavity.

11. A vane pump as recited in claim 10, further comprising means associated with the first surface of each end plate for communicating fluid from the discharge arc region of the pumping cavity to the undervane portion of each vane element when each vane element passes through the discharge and seal arc regions and for communicating fluid from the inlet arc region of the pumping cavity to the undervane portion of each vane element when each vane element passes through the inlet arc regions as the rotor member rotates about the central axis.

12. A vane pump as recited in claim 10, wherein the rotor member further comprises a plurality of substantially axial fluid passages formed in the central body portion of the rotor, each passage positioned between the plurality of circumferentially spaced apart radial vane slots and providing a path through the rotor body portion for fluid to communicate axially from the pumping cavity to the first and second end plate.

13. A vane pump as recited in claim 8, wherein the radially inner edge of the circumferential recess formed in the first end surface of the rotor member is spaced from the central axis by a radial distance, the radial distance defining an amount of allowable vane tip surface wear which can occur before high pressure fluid can leak from the discharge arc region to the inlet arc region of the pumping cavity.

14. A vane pump as recited in claim 8, wherein the second end surface of the body portion of the rotor member has a circumferential recess formed in a radially outer portion thereof so as to create a leak path for communicating fluid from the discharge arc region to the inlet arc region when the cam member is in a start-up position and an undervane portion of a vane element is positioned radially outward of a radially inner edge of the recess formed in the second end surface when such vane is positioned in the seal arc region of the pumping cavity.

* * * * *